US006819299B2

(12) United States Patent
Miyazaki

(10) Patent No.: US 6,819,299 B2
(45) Date of Patent: Nov. 16, 2004

(54) RADIO WAVE RECEIVING CONVERTER AND ANTENNA DEVICE

(75) Inventor: Ryoko Miyazaki, Nishinomiya (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/353,967

(22) Filed: Jan. 30, 2003

(65) Prior Publication Data

US 2003/0156071 A1 Aug. 21, 2003

(30) Foreign Application Priority Data

Feb. 15, 2002 (JP) ..... 2002-038883

(51) Int. Cl.[7] ..... H01Q 13/00
(52) U.S. Cl. ..... 343/786; 343/772
(58) Field of Search ..... 343/772, 786, 343/781 R, 878

(56) References Cited

U.S. PATENT DOCUMENTS 6,023,246 A * 2/2000 Tanabe ..... 343/753
6,320,554 B1 * 11/2001 Yuanzhu ..... 343/786

FOREIGN PATENT DOCUMENTS

JP 02000183617 A * 6/2000 ..... H01Q/13/02

* cited by examiner

*Primary Examiner*—Shih-Chao Chen
(74) *Attorney, Agent, or Firm*—Birch, Stewart, Kolasch & Birch, LLP

(57) ABSTRACT

A radio wave receiving converter in accordance with the present invention is for receiving satellite broadcast, and includes a body portion having a first feed horn portion, a second feed horn portion connected to first feed horn portion, and a sheet sandwiched between first feed horn portion and second feed horn portion and maintaining air tightness at a connected portion of first feed horn portion and second feed horn portion. An antenna device in accordance with the present invention includes the radio wave receiving converter as described above and a reflective parabolic portion reflecting a received radio wave and leading it to the radio wave receiving converter.

22 Claims, 15 Drawing Sheets

RADIO WAVE RECEIVING CONVERTER AND ANTENNA DEVICE

BACKGROUND OF THE INVENTION

1. Field of the Invention

The present invention generally relates to a radio wave receiving converter (LNB: Low Noise Block down Converter) for receiving a radio wave from satellite, and to an antenna device. More particularly, the present invention relates to a feed horn connected structure of a radio wave receiving converter, and to an antenna device with the radio wave receiving converter.

2. Description of the Background Art

In many LNBs, a body portion and a feed horn are integrated together. FIG. 15 shows a structure of a general LNB. As shown in FIG. 15, the LNB includes a body portion 1 and a feed horn portion 2. As illustrated in FIGS. 16A and 16B, feed horn portion 2 includes a first feed horn portion 2*a* on the side of body portion 1, and a second feed horn portion 2*b*. FIG. 16B illustrates an enlarged cross-sectional view of a region 21 of FIG. 16A.

In the conventional LNB, for some reasons relating to a fabrication of a mold for a body, a part of feed horn portion 2 was sometimes fabricated in a mold different from the one for body portion 1. In this case, first feed horn portion 2*a* and second feed horn portion 2*b* are connected together somewhere along feed horn portion 2.

First feed horn portion 2*a* and second feed horn portion 2*b* both have screw portions 11, and are connected together via screw portions 11. Through the application of a high-viscosity or pasty liquid sealing agent or an adhesive to gaps between screw portions 11 at this connected portion, air tightness between first feed horn portion 2*a* and second feed horn portion 2*b* is maintained.

The application of the liquid sealing agent or the adhesive to the screw portions 11 is, however, difficult to perform. In addition, operational variations could be large. Since a low-viscosity sealing agent or the like cannot be used, there is no other way but to utilize a high-viscosity sealing agent. Because of this, the sealing agent cannot smoothly get through to the little gaps, and an air can be easily entrained in the sealing agent. As a result, the air tightness may not be ensured.

SUMMARY OF THE INVENTION

An object of the present invention is to improve the workability regarding a connection of feed horn portions of a radio wave receiving converter, and to improve the reliability of the radio wave receiving converter by maintaining ensured air tightness at a feed horn connected portion.

Another object of the present invention is to provide an antenna device with a highly reliable radio wave receiving converter.

A radio wave receiving converter in accordance with the present invention is for receiving satellite broadcast. In one aspect, the radio wave receiving converter includes a body portion having a first feed horn portion, a second feed horn portion connected to the first feed horn portion, and a sheet sandwiched between the first feed horn portion and the second feed horn portion and maintaining air tightness at a connected portion of the first and the second feed horn portions.

By sandwiching the sheet for sealing between the first and second feed horn portions as described above, the air tightness at the feed horn connected portion can be maintained. As the sheet, a sheet with an adhesive is preferably used. As a result, by simply adhering the sheet to one feed horn portion and applying the other feed horn portion thereto, the sheet can be sandwiched between the feed horn portions. In addition, the air tightness at the feed horn connected portion can be improved.

An elastic body is preferably inserted between the above-described sheet and the first or the second feed horn portion. As a result, a force, which is to be developed when the second feed horn portion is screwed into the first feed horn portion, cannot be directly exerted to the sheet. Therefore, a breakage or a peeling of the above-described sheet can be avoided, and the adhesion of the sheet can be improved.

In another aspect, a radio wave receiving converter in accordance with the present invention includes a body portion including a first feed horn portion having a first screw portion, a second feed horn portion connected to the first feed horn portion and having a second screw portion screwed into the first screw portion, and a sealing portion provided at a region away from the first and second screw portions and maintaining air tightness at a connected portion of the first and the second feed horn portions.

Such a provision of the sealing portion at the region away from the first and second screw portions allows easier provision of the sealing portion, compared to the case in which the sealing portion is provided at the screw portion. For example, when a liquid sealing agent or an adhesive is used as a sealing agent, a low-viscosity liquid sealing agent or the like can be utilized, if a groove portion is provided and filled with the sealing agent or the like as described below. This facilitates the application or filling work of the liquid sealing agent or the like. In addition, through the use of the low-viscosity liquid sealing agent or the like, an air-void entrainment in the sealing agent or the like can be avoided, and the sealing agent or the like can spread all across the sealing portion.

The second feed horn portion described above may have an extension extending over an outer circumference of the first feed horn portion. In this case, the body portion has a groove portion receiving an end of the extension, and the sealing portion is provided in this groove portion. The sealing portion may include at least one of a sealing agent and a packing.

The sealing portion may be provided between the end of the second feed horn portion and a receiving portion on the first feed horn portion for receiving the end (a joint portion, a coupling portion, or an abutment portion with the second feed horn portion). In this case as well, the sealing portion can easily be provided, and additionally, an improvement in sealing can be obtained.

The groove portion may be provided at the receiving portion described above, and the sealing portion may be provided in the groove portion. In this case, the sealing portion includes at least one selected from the group consisting of an O ring, a packing, and a sealing agent.

The sealing portion described above may include an elastic body mounted to at least one of the end of the second feed horn portion and the receiving portion on the first feed horn portion. For instance, a resin, a rubber, or the like can be baked on a joint surface of the first feed horn portion joined with the end of the second feed horn portion, in order to form the elastic body.

In still another aspect, a radio wave receiving converter in accordance with the present invention includes a body portion including a first feed horn portion, a second feed horn portion connected to the first feed horn portion, a standing wall portion provided at the first feed horn portion and forming, in the first feed horn portion, a groove portion receiving a part of the second feed horn portion, and a sealing portion provided in the groove portion and maintaining air tightness at a connected portion of the first and the second feed horn portions.

In the present aspect as well, the groove portion is provided at the first feed horn portion, and the sealing portion is provided in the groove portion. Accordingly, a low-viscosity liquid sealing agent or the like can be utilized. As a result, as in the other aspects, the sealing portion can easily be provided, and additionally, an improvement in sealing can be achieved.

The sealing portion includes a sealing agent filled into the groove portion. In this case, a low-viscosity liquid sealing agent can be employed, and an improvement in sealing can be achieved in addition to the easier application of the sealing agent.

An antenna device in accordance with the present invention includes the radio wave receiving converter described above and a reflective parabolic portion reflecting a received radio wave and leading it to the radio wave receiving converter.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 4B is an enlarged cross-sectional view of a region 18 in FIG. 4A.

DESCRIPTION OF THE PREFERRED EMBODIMENTS

In the following, embodiments in accordance with the present invention will be described with reference to FIGS. 1 to 14.

(First Embodiment).

Figure 1:
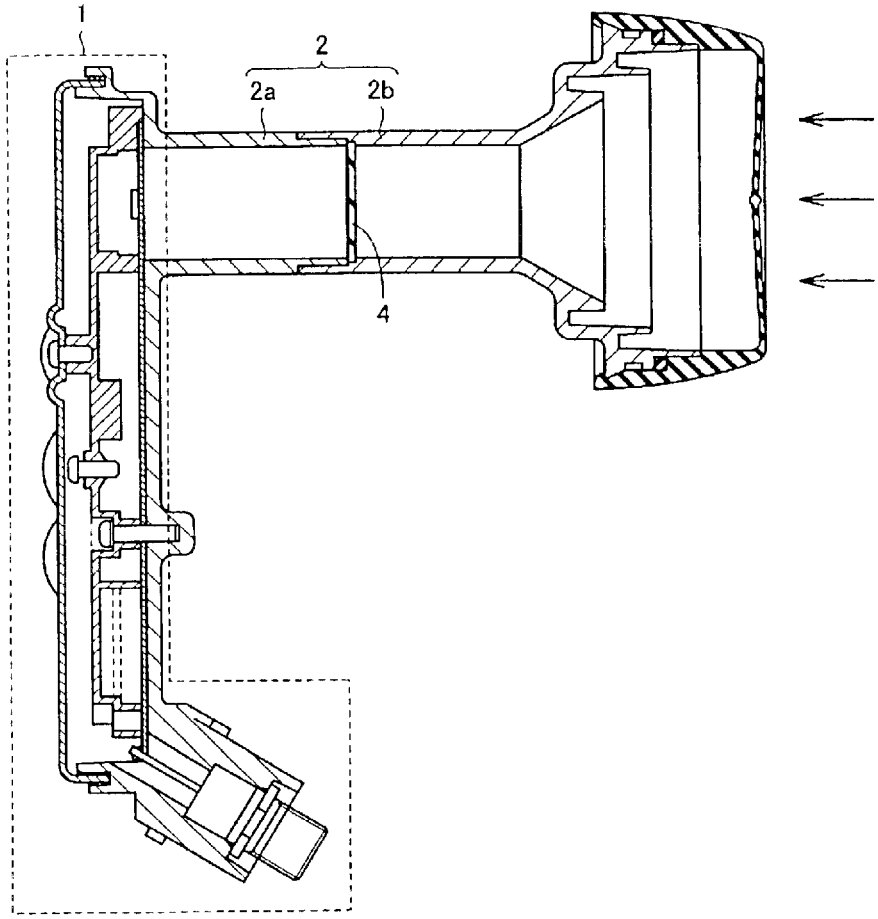
FIG. 1 is a cross-sectional view of a feed horn-integrated type radio wave receiving converter (LNB) in accordance with a first embodiment of the present invention.
Figure 2A:
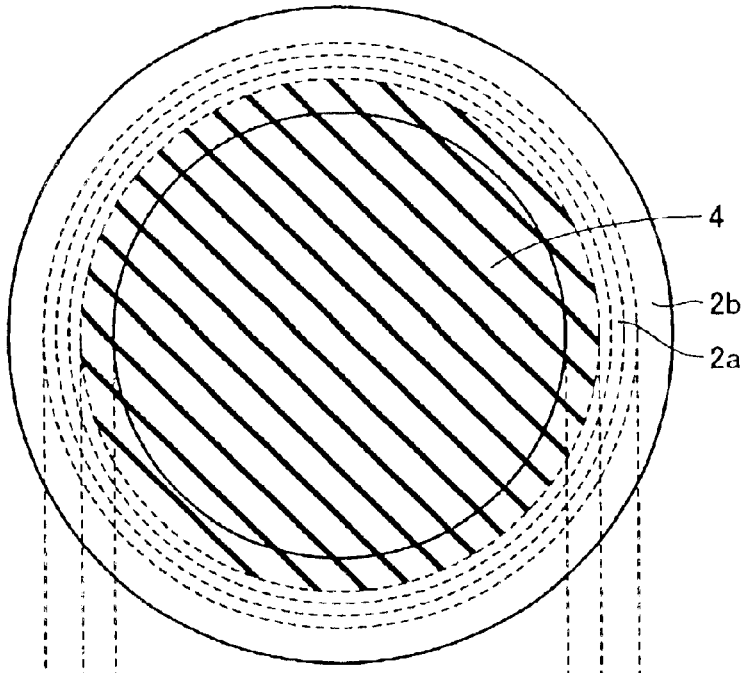
FIG. 2A is a plan view of a feed horn connected portion of the radio wave receiving converter in accordance with the first embodiment.
Figure 2B:
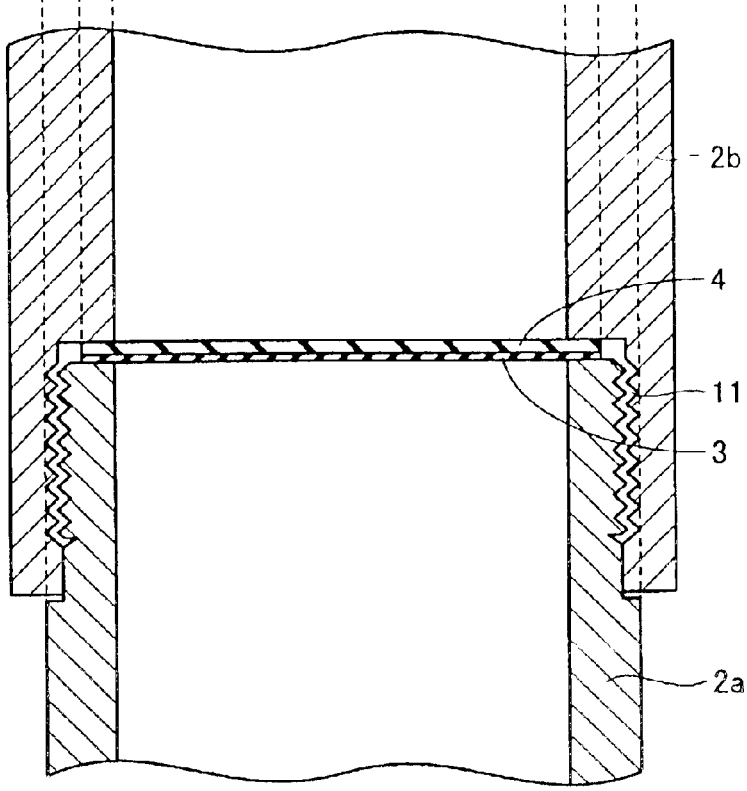
FIG. 2B is a cross-sectional view of the feed horn connected portion.

FIG. 1 is a cross-sectional view of a feed horn-integrated type radio wave receiving converter (LNB) in accordance with a first embodiment of the present invention. FIG. 2A is a plan view of a feed horn connected portion of the LNB in accordance with the first embodiment. FIG. 2B is a cross-sectional view of the feed horn connected portion.

As shown in FIG. 1, the LNB includes a body portion 1 in which a high frequency circuit board or the like is provided, and a feed horn portion 2 receiving a radio wave from satellite.

Feed horn portion 2 has a first feed horn portion 2*a* and a second feed horn portion 2*b*. First feed horn portion 2*a* is on the side of body portion 1, and has a screw portion (a first screw portion) 11 near its end portion (see FIG. 2B). Second feed horn portion 2*b* also has a screw portion (a second screw portion) 11 near its end portion. First feed horn portion 2*a* and second feed horn portion 2*b* are connected via screw portions 11.

As shown FIGS. 2A and 2B, a sheet 4 is sandwiched between first feed horn portion 2*a* and second feed horn portion 2*b*. More specifically, sheet 4 is provided on a joint surface between first feed horn portion 2*a* and second feed horn portion 2*b* (an end surface of first feed horn portion 2*a* radially inward from screw portion 11 and an end surface of an inner circumference of second feed horn portion 2*b*). As a result, air tightness can be maintained at the connected portion of first and second feed horn portions 2*a* and 2*b*, and the reliability of the LNB can be improved.

As shown in FIG. 2A, by sandwiching the entire perimeter of sheet 4 between first feed horn portion 2*a* and second feed horn portion 2*b*, the connected portion of first and second feed horn portions 2*a* and 2*b* can be maintained with higher air tightness.

Furthermore, one of first feed horn portion 2*a* and second feed horn portion 2*b* presses the outer edge of sheet 4 against the other. Therefore, even when the internal pressure in feed horn portion 2 rises so that a force acts in the direction that peels off sheet 4, a peeling, a lifting, or the like of sheet 4 can be avoided. This can also contribute to an improvement in air tightness.

In addition, since sheet 4 is simply sandwiched between first feed horn portion 2*a* and second feed horn portion 2*b*, sheet 4 can be provided easily.

A material for sheet 4 is resin such as PET (polyethylene terephthalate), or metallic foil such as aluminum or copper. The example shown in FIGS. 2A and 2B employs sheet 4 having an adhesive layer (a viscous layer) 3 on one of the surfaces thereof. The employment of the above-described sheet 4 enables the air tightness to be maintained more effectively at the feed horn connected portion.

Moreover, since such a simple work is enough as to adhere sheet 4 to one of first and second feed horn portions 2*a* and 2*b*, further improvement in workability can be achieved.

In the example of FIGS. 2A and 2B, sheet 4 with the adhesive is applied to first feed horn portion 2*a*. Sheet 4, however, may be adhered to second feed horn portion 2*b*. In addition, adhesive layer (viscous layer) 3 may be formed on both surfaces of sheet 4, and sheet 4 may have a multilayer structure.

(Second Embodiment)

Figure 3:
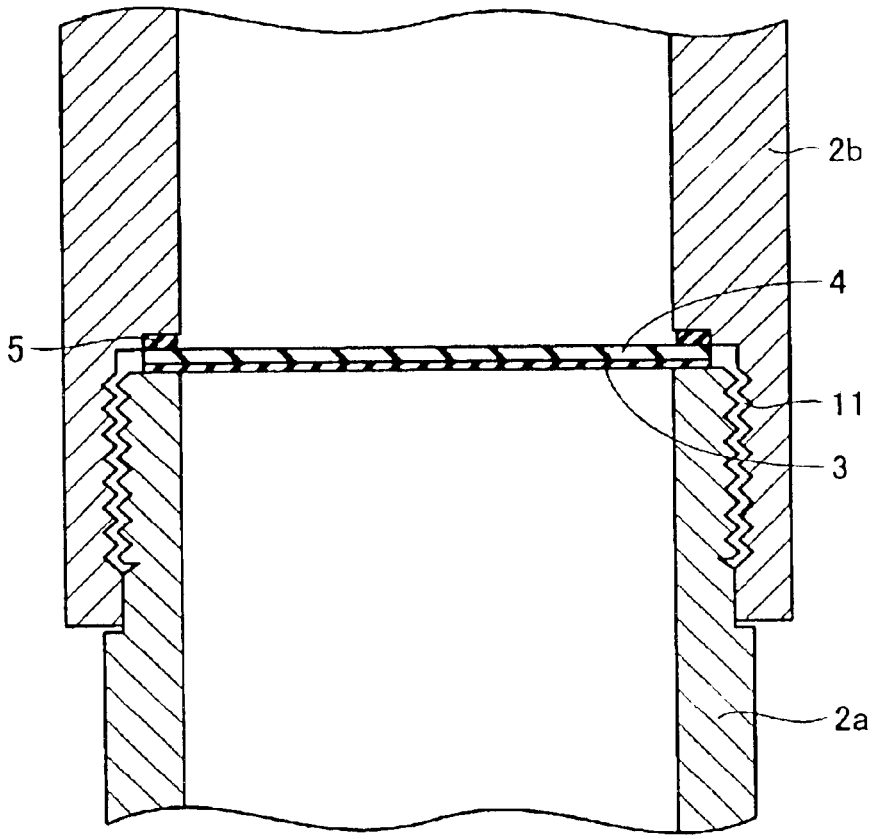
FIG. 3 is a cross-sectional view of the feed horn connected portion of the radio wave receiving converter in accordance with a second embodiment of the present invention.

A second embodiment of the present invention will now be described with reference to FIG. 3. FIG. 3 is a cross-sectional view of the feed horn connected portion of the LNB in accordance with the second embodiment of the present invention.

As shown in FIG. 3, in the second embodiment, an elastic body 5 is inserted between second feed horn portion 2*b* and sheet 4. That is, second feed horn portion 2*b* presses sheet 4 with elastic body 5 posed therebetween. Other configurations are similar to those in the first embodiment.

Because of the provision of elastic body 5 as described above, when the feed horn portions are screwed together during assembly of the LNB, a force applied to screw the feed horn portions together cannot directly be transmitted to sheet 4. As a result, sheet 4 itself cannot be broken or twisted by this force. In addition, the thickness of elastic body 5 is variable. Accordingly, accuracy regarding the position where the feed horn portion is to be mounted cannot be affected.

A material for elastic body 5 is resin such as urethane or foam rubber or the like. It is noted that sheet 4 may be adhered to second feed horn portion 2*b* and that elastic body 5 may be provided between sheet 4 and first feed horn portion 2*a*.

(Third Embodiment)

Figure 4A:
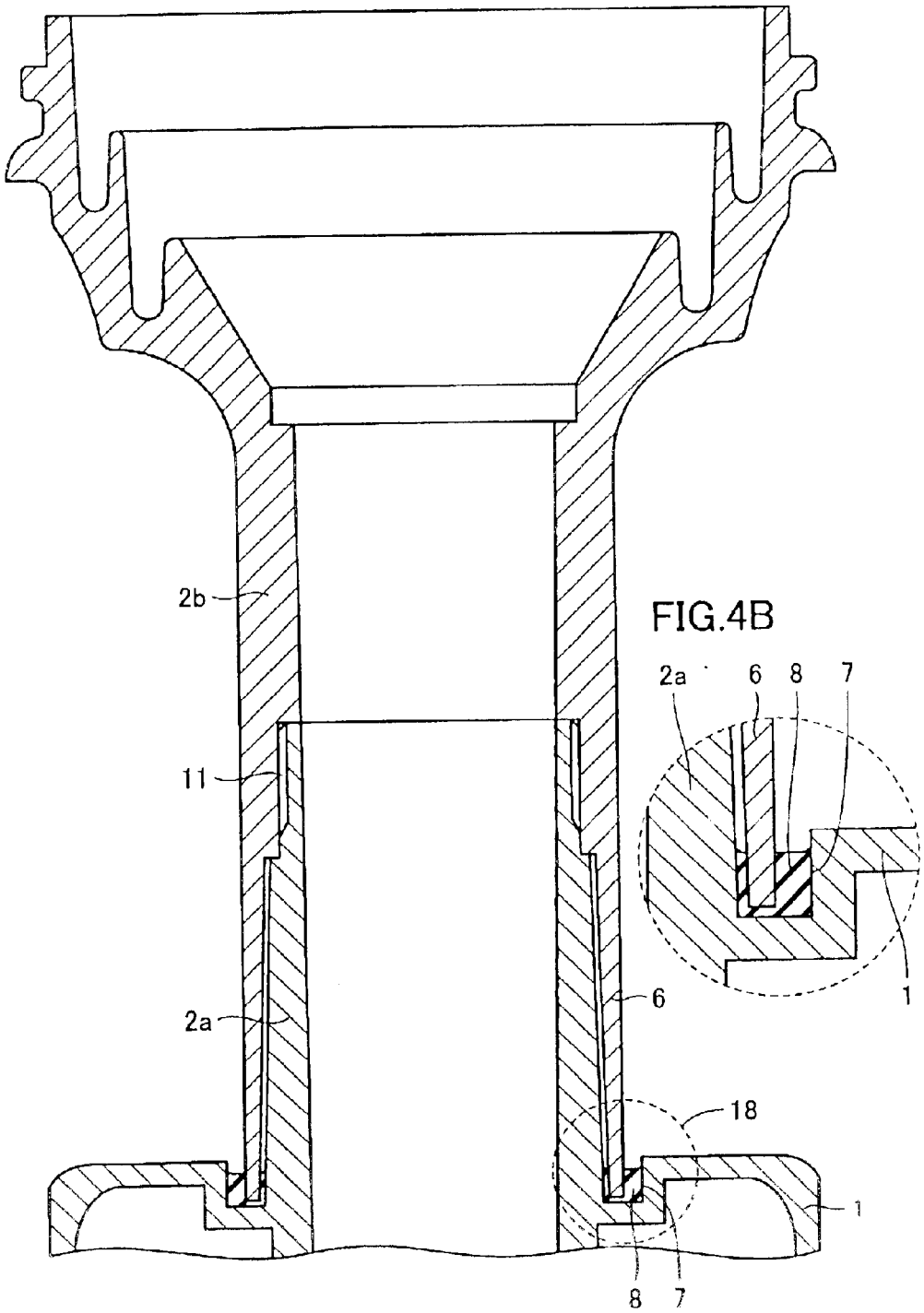
FIG. 4A is a cross-sectional view of the feed horn connected portion of the radio wave receiving converter in accordance with a third embodiment of the present invention.
Figure 6A:
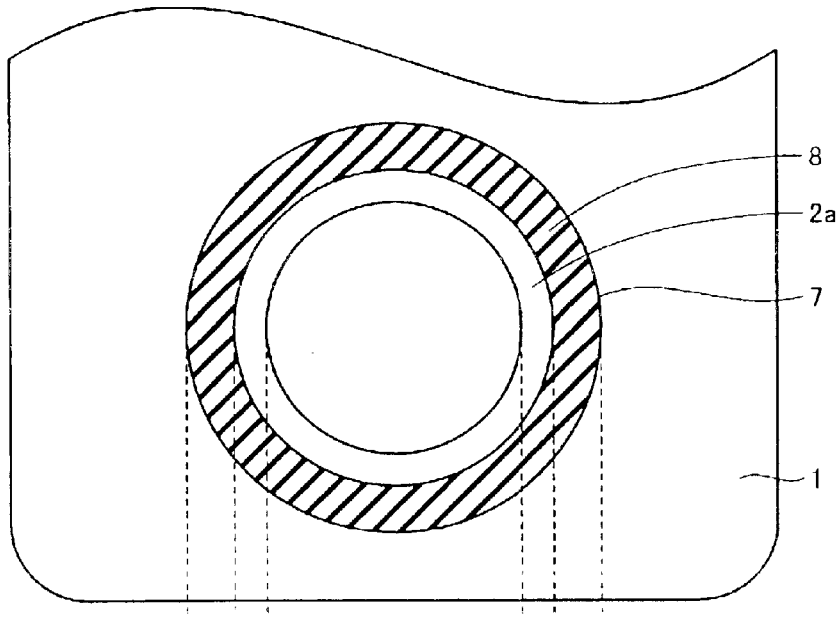
FIG. 6A is a plan view of the feed horn portion on the body side of the radio wave receiving converter in FIG. 4A.
Figure 6B:
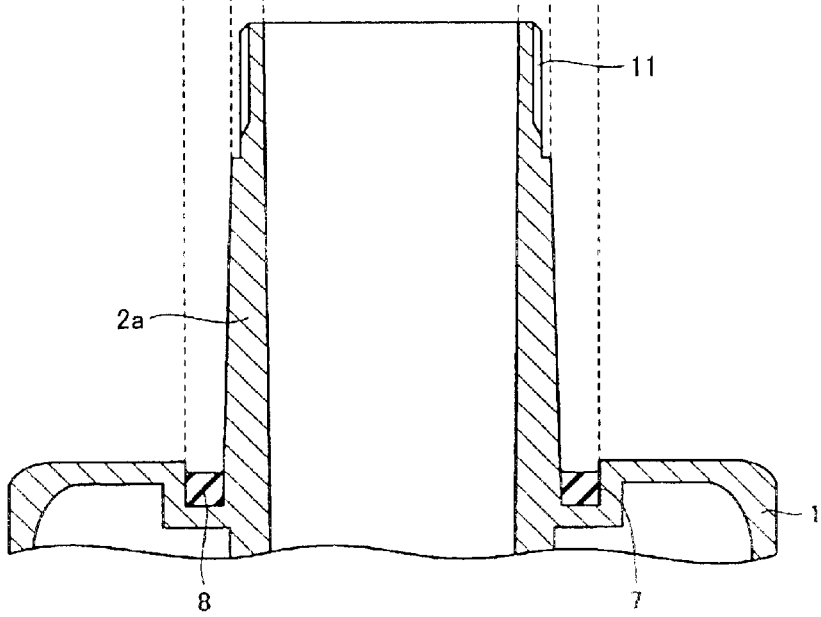
FIG. 6B is a cross-sectional view of the feed horn portion shown in FIG. 6A.

A third embodiment of the present invention will now be described with reference to FIGS. 4A, 4B, 6A and 6B. FIG. 4A is a cross-sectional view of the feed horn connected portion of the LNB in accordance with the third embodiment of the present invention. FIG. 4B is an enlarged cross-sectional view of a region 18 in FIG. 4A. FIG. 6A is a plan view of first feed horn portion 2*a* and body portion 1. FIG. 6B is a cross-sectional view of first feed horn portion 2*a* and body portion 1 shown in FIG. 6A.

As shown in FIG. 4A, screw portions 11 are respectively formed on the outer circumference of first feed horn portion 2*a* leading to body portion 1 of the LNB, and on the inner circumference of second feed horn portion 2*b*. By screwing these screw portions 11 together, first feed horn portion 2*a* and second feed horn portion 2*b* can be connected.

In the third embodiment, a sealing portion is provided in a region away from screw portions 11. More specifically, an end of second feed horn portion 2*b* is provided with an extension 6 extending to surround the outer circumference of first feed horn portion 2*a*, and the sealing portion is provided radially outward from screw portions 11.

In the examples shown in FIGS. 4A, 4B, 6A, and 6B, body portion 1 is provided with an annular groove portion 7 receiving the end of extension (outer circumference) 6 of second feed horn portion 2*b*, and the sealing portion is provided in groove portion 7. That is, the sealing portion is provided between second feed horn portion 2*b* and body portion 1.

The sealing portion can be formed, for example, by filling a liquid sealing agent 8 in groove portion 7. Through the provision of such sealing portion, the air tightness can be maintained at the feed horn connected portion.

In addition, the provision of groove portion 7 as described above allows the use of a low-viscosity sealing agent.

When the low-viscosity sealing agent is utilized, the work operation can be automated through the use of a dispenser. This can improve the workability. The low-viscosity sealing agent can spread all across groove portion 7 in a short time, and a possible air-void entrainment in the application of the sealing agent would be avoided. Accordingly, the reliability regarding the air tightness at the feed horn connected portion can be improved.

(Fourth Embodiment)

Figure 5:
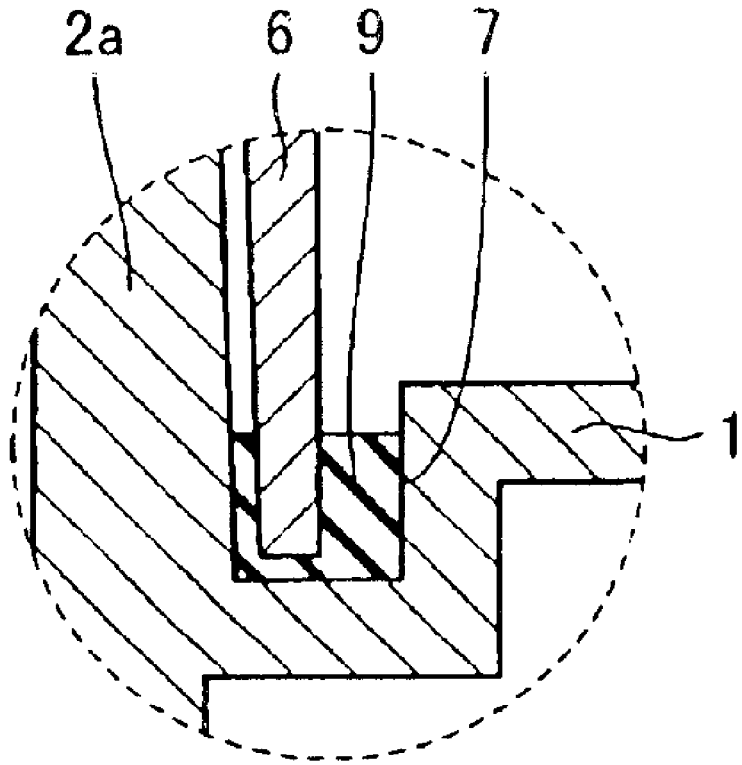
FIG. 5 is a partially enlarged cross-sectional view of the feed horn connected portion of the radio wave receiving converter in accordance with a fourth embodiment of the present invention.

A fourth embodiment of the present invention will now be described with reference to FIG. 5. FIG. 5 is a partially enlarged cross-sectional view of the feed horn connected portion of the LNB in accordance with the fourth embodiment of the present invention.

As shown in FIG. 5, in the fourth embodiment, a rubber packing 9 is provided in groove portion 7 shown in FIG. 4A. Other configurations are similar to those in the third embodiment.

In the fourth embodiment, rubber packing 9 is simply fitted into groove portion 7 as described above. Accordingly, the workability can be improved compared to the case in which a sealing agent is employed. In addition, when an O ring is utilized, feed horn portions 2 can be separated easily. Thus, even at the breakage of feed horn portion 2, a replacement thereof can be performed easily, and a cost which would be wasted due to a defective product can be minimized.

(Fifth Embodiment)

Figure 7:
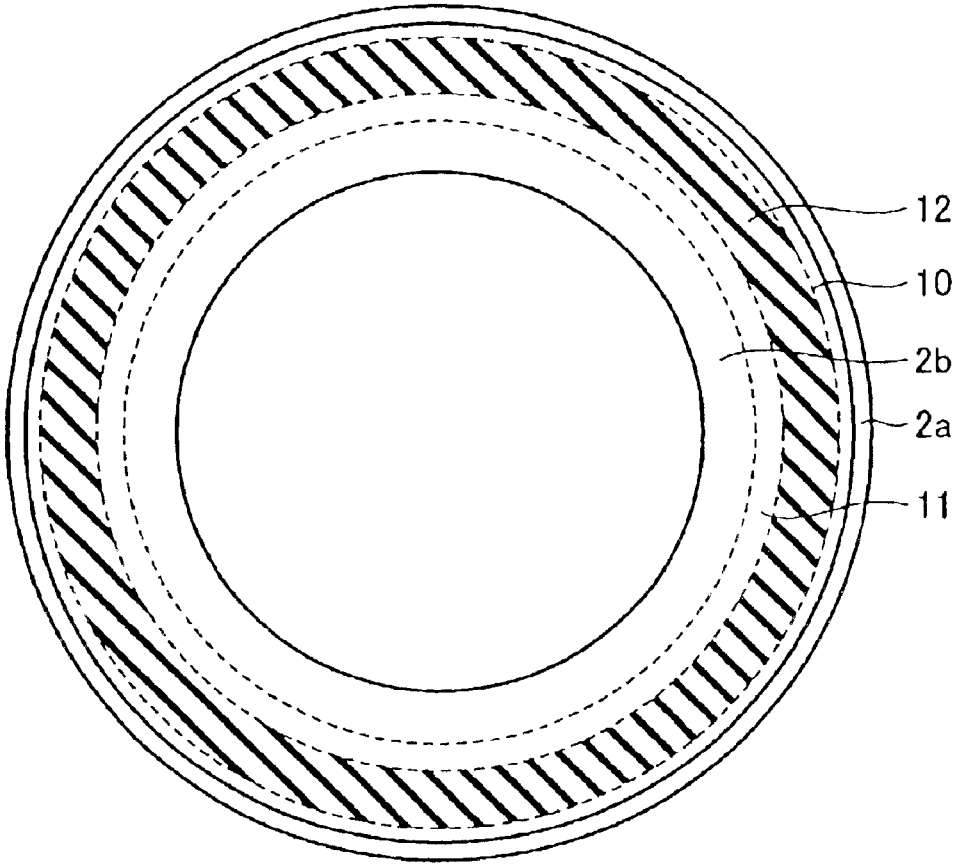
FIG. 7 is a plan view of the feed horn connected portion of the radio wave receiving converter in accordance with a fifth embodiment of the present invention.
Figure 8A:
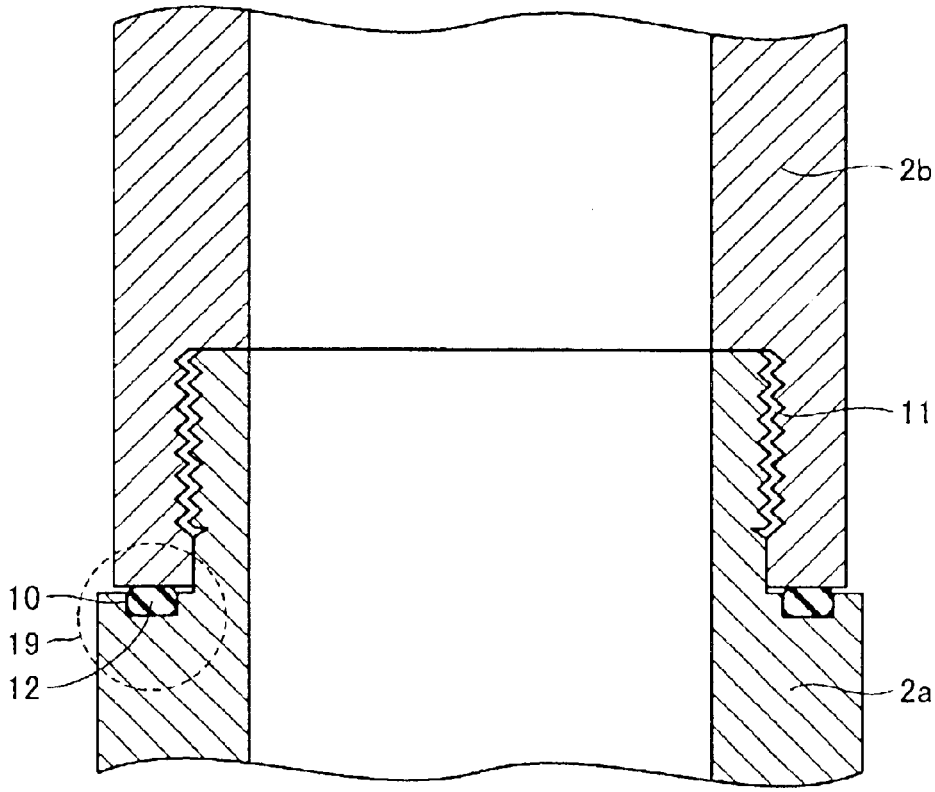
FIG. 8A is a cross-sectional view of the feed horn connected portion of the radio wave receiving converter in accordance with the fifth embodiment of the present invention.
Figure 8B:
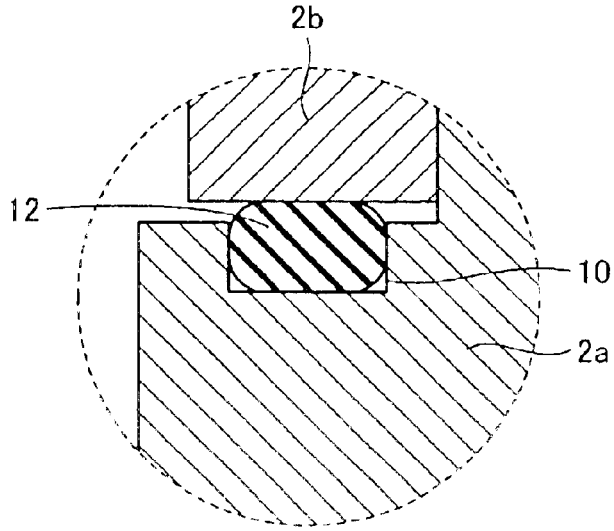
FIG. 8B is an enlarged cross-sectional view of a region 19 shown in FIG. 8A.

A fifth embodiment of the present invention will now be described with reference to FIGS. 7, 8A, and 8B. FIG. 7 is a plan view of the feed horn connected portion of the LNB in accordance with the fifth embodiment. FIG. 8A is a cross-sectional view of the feed horn connected portion of the LNB in accordance with the fifth embodiment. FIG. 8B is an enlarged cross-sectional view of a region 19 in FIG. 8A.

As shown in FIGS. 7, 8A, and 8B, in the fifth embodiment as well, the sealing portion is provided in a region away from screw portion 11. More specifically, an annular groove portion 10 is provided in the portion on an axial end surface of first feed horn portion 2*a*, which is radially outward from screw portions 11, (a wall surface on the outer circumference side), and a sealing rubber packing (a sealing member) 12 is provided in this groove portion 10.

As shown in FIGS. 8A and 8B, the end of second feed horn portion 2*b* is pressed against rubber packing 12 on the outer circumferential portion of first feed horn portion 2*a*. As a result, the air tightness at the feed horn connected portion can be maintained. As a sealing member, an O ring or the like can be utilized in addition to rubber packing 12.

As in the fourth embodiment, the feed horns are separated easily in the present embodiment as well. Accordingly, a cost which would be wasted due to a defective product can be minimized.

(Sixth Embodiment)

Figure 9:
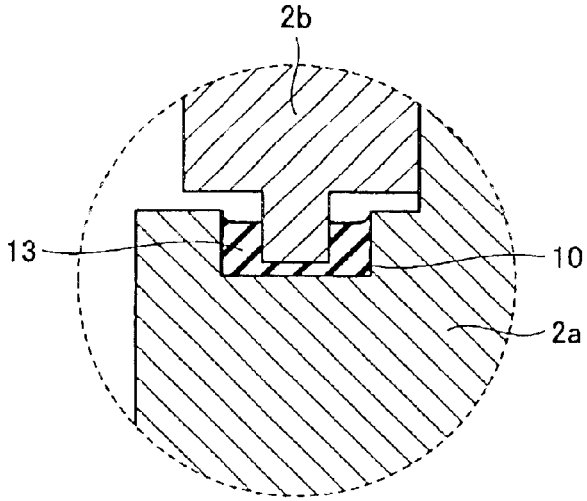
FIG. 9 is a partially enlarged cross-sectional view of the feed horn connected portion of the radio wave receiving converter in accordance with a sixth embodiment of the present invention.

A sixth embodiment of the present invention will now be described with reference to FIG. 9. FIG. 9 is a partially enlarged cross-sectional view of the feed horn connected portion of the LNB in accordance with the sixth embodiment.

As shown in FIG. 9, in the sixth embodiment, a low-viscosity sealing agent 13 is utilized instead of rubber packing 12 in the fifth embodiment. In this case, a convex portion is provided at the end of second feed horn portion 2*b*, and the convex portion is inserted in sealing agent 13.

Configurations other than those described above are similar to those in the fifth embodiment, and thus, a description thereof will not be given.

In the present embodiment, the convex portion of second feed horn portion 2*b* is pushed into sealing agent 13 in first feed horn portion 2*a*. Therefore, a sealing can be attained both in the inner side and the outer side of the convex portion. As a result, the air tightness at the feed horn connected portion can be maintained.

For assembly of the LNB, sealing agent 13 is filled into groove portion 10 in the wall surface of first feed horn portion 2*a*, and a part of second feed horn portion 2*b* is inserted into sealing agent 13. Accordingly, the assembly is performed easily, and an improvement in workability can be achieved.

(Seventh Embodiment)

Figure 10:
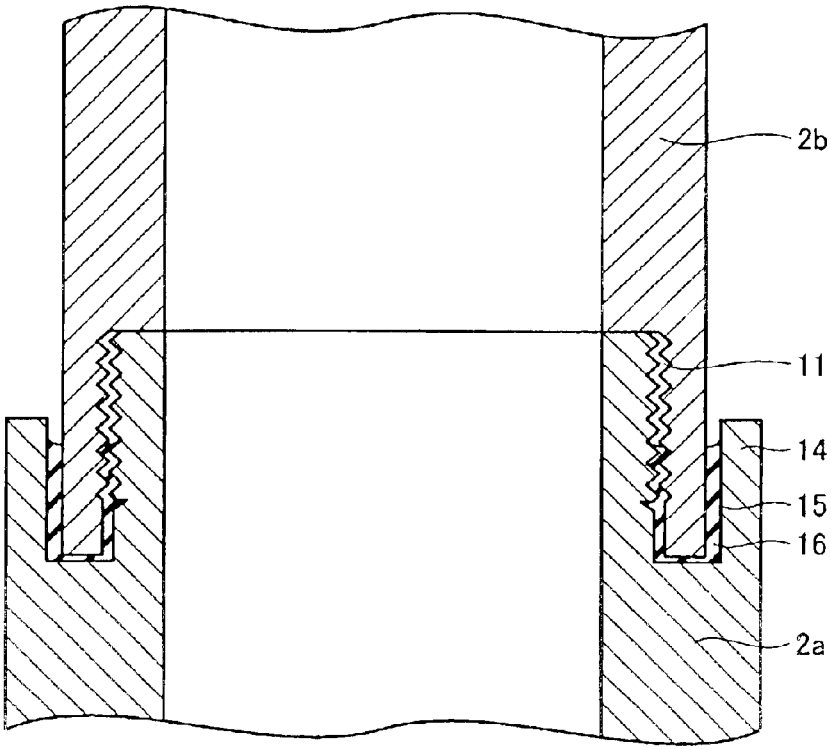
FIG. 10 is a cross-sectional view of the feed horn connected portion of the radio wave receiving converter in accordance with a seventh embodiment of the present invention.

A seventh embodiment of the present invention will now be described with reference to FIG. 10. FIG. 10 is a cross-sectional view of the feed horn connected portion of the LNB in accordance with the seventh embodiment.

In the seventh embodiment, the outer circumferential portion (a portion located radially outward from screw portion 11) of first feed horn portion 2*a* is extended to form a standing wall portion (rib) 14 so that a groove portion 15 is provided in first feed horn portion 2*a*. A sealing agent 16 is filled into groove portion 15. The end of second feed horn portion 2*b* is received within groove portion 15. Consequently, the sealing portion is provided, which reaches the outer circumference of second feed horn portion 2*b*.

Standing wall portion 14 has a height reaching screw portion 11 of first feed horn portion 2*a*. The inner circumference of this standing wall portion 14 defines the outer circumference of groove portion 15. In the example shown in FIG. 10, sealing agent 16 is filled into groove portion 15 such that it reaches screw portions 11 of first and second feed horn portions 2*a* and 2*b* and contacts the outer circumference of second feed horn portion 2*b*.

As a result, the sealing portion can be formed not only between screw portions 11 of first and second feed horn portions 2*a* and 2*b*, but between the outer circumference of second feed horn portion 2*b* and standing wall portion 14 of first feed horn portion 2*a*. Accordingly, the air tightness can be maintained at the feed horn connected portion.

As sealing agent 16, a low-viscosity sealing agent is preferably employed. This can facilitate the filling of sealing agent 16 as well as improve the reliability of the sealing portion. In addition, by heightening standing wall portion 14 as described above, spillage of sealing agent 16 can be prevented. This can also contribute to an improvement in workability and reliability as described above.

(Eighth Embodiment)

Figure 12A:
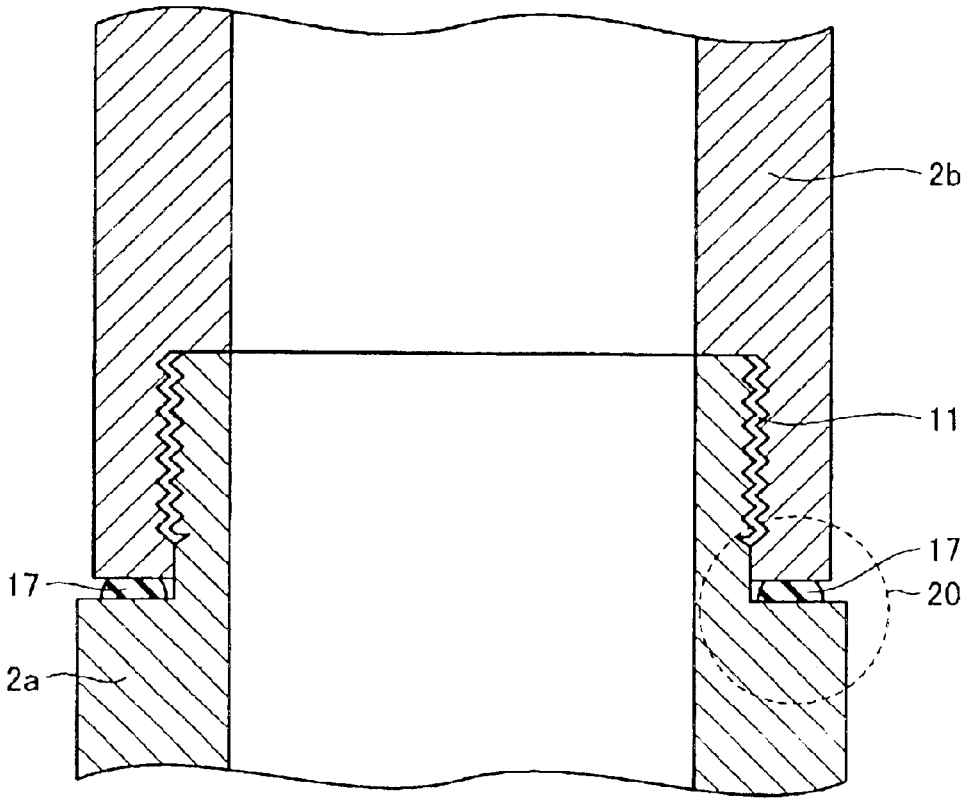
FIG. 12A is a cross-sectional view of the feed horn connected portion of the radio wave receiving converter in accordance with the eighth embodiment of the present invention.
Figure 12B:
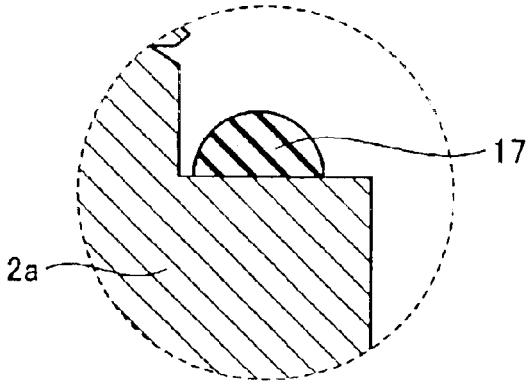
FIG. 12B is an enlarged cross-sectional view of a region 20 shown in FIG. 12A.
Figure 13:
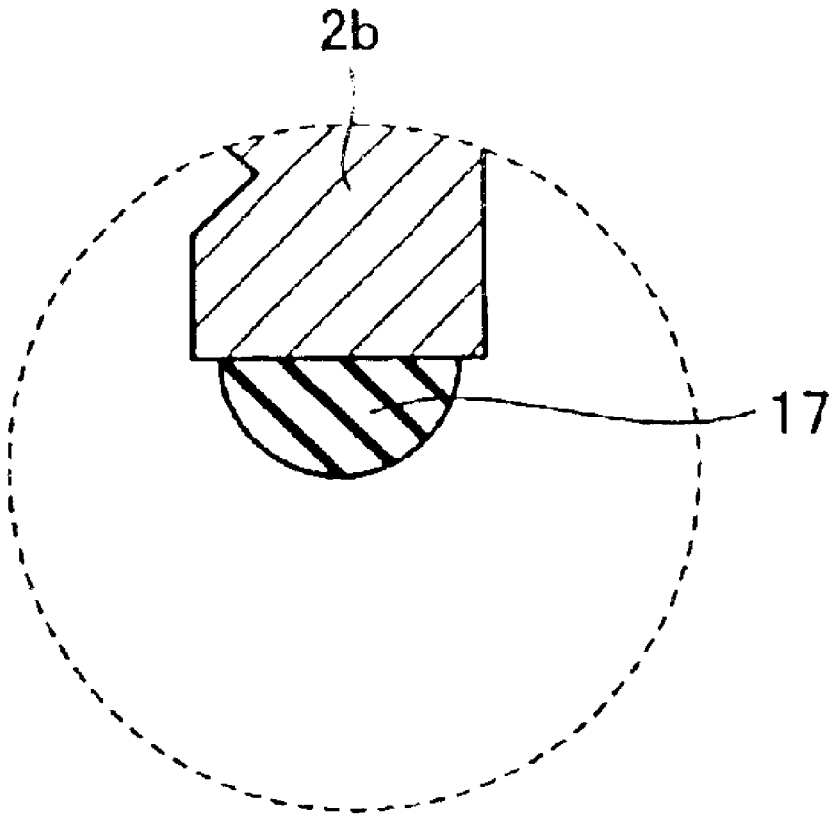
FIG. 13 is a partially enlarged cross-sectional view of the feed horn portion of the radio wave receiving converter in accordance with a modification to the eighth embodiment of the present invention.

An eighth embodiment of the present invention and a modification thereto will now be described with reference to FIGS. 11 to 13.

Figure 11:
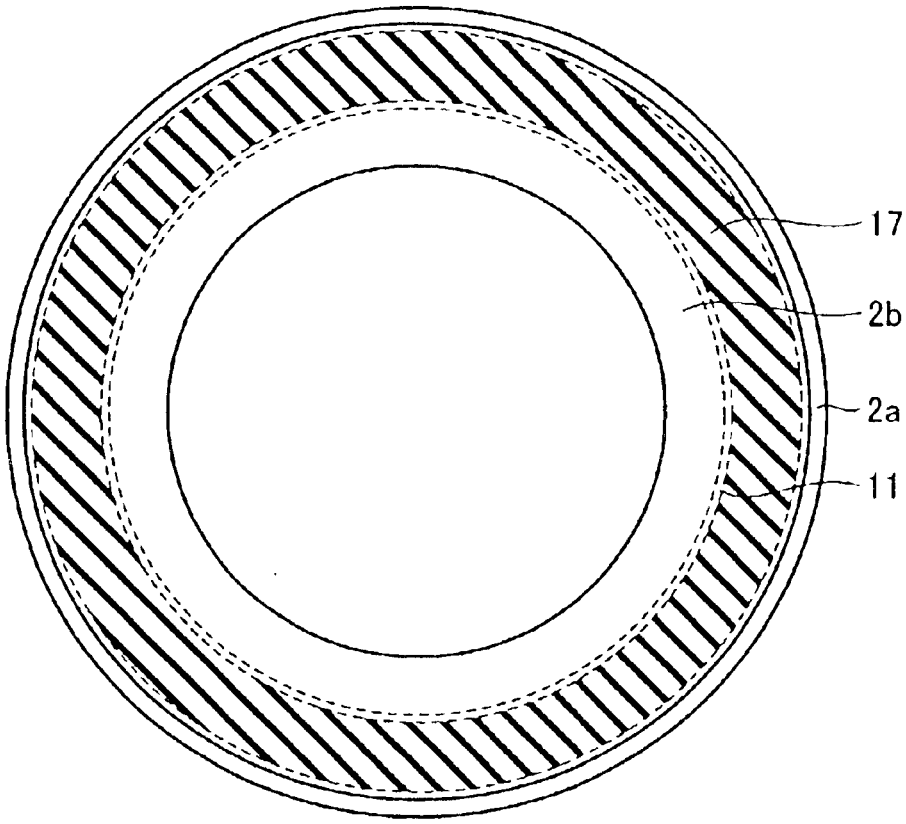
FIG. 11 is a plan view of the feed horn connected portion of the radio wave receiving converter in accordance with an eighth embodiment of the present invention.

FIG. 11 is a plan view of the feed horn connected portion of the LNB in accordance with the eighth embodiment. FIG. 12A is a cross-sectional view of the feed horn connected portion of the LNB in accordance with the eighth embodiment. FIG. 12B is a partially enlarged cross-sectional view of the feed horn portion on the LNB body side. FIG. 13 is a partially enlarged cross-sectional view of the feed horn portion of the LNB in accordance with a modification to the eighth embodiment.

In the eighth embodiment as well, the sealing portion is provided at a region away from screw portions 11. More specifically, as shown in FIG. 11, an annular protrusion 17 made from an elastic body is provided at the wall surface of first feed horn portion 2*a*, which is radially outward from screw portions 11. As shown in FIG. 12A, the end of second feed horn portion 2*b* is pressed against protrusion 17.

Protrusion 17 can be formed, for instance, by baking a rubber on the end portion of first feed horn portion 2*a*. By pressing the end of second feed horn portion 2*b* against this protrusion 17, the air tightness at the feed horn connected portion can be maintained.

Above-described protrusion 17 can be formed on first feed horn portion 2*a* prior to assembly of the LNB. Therefore, in assembly of the LNB, second feed horn portion 2*b* may simply be screwed into first feed horn portion 2*a*. Accordingly, a reduction in assembly cost is possible, and operational variations can be small.

In addition, since a separation of feed horn portions 2 is easy, a cost which would be wasted due to a defective product can be minimized. As shown in FIG. 13, protrusion 17 may be formed on second feed horn portion 2*b* by baking. The similar effect can be obtained in this case as well.

(Ninth Embodiment)

Figure 14:
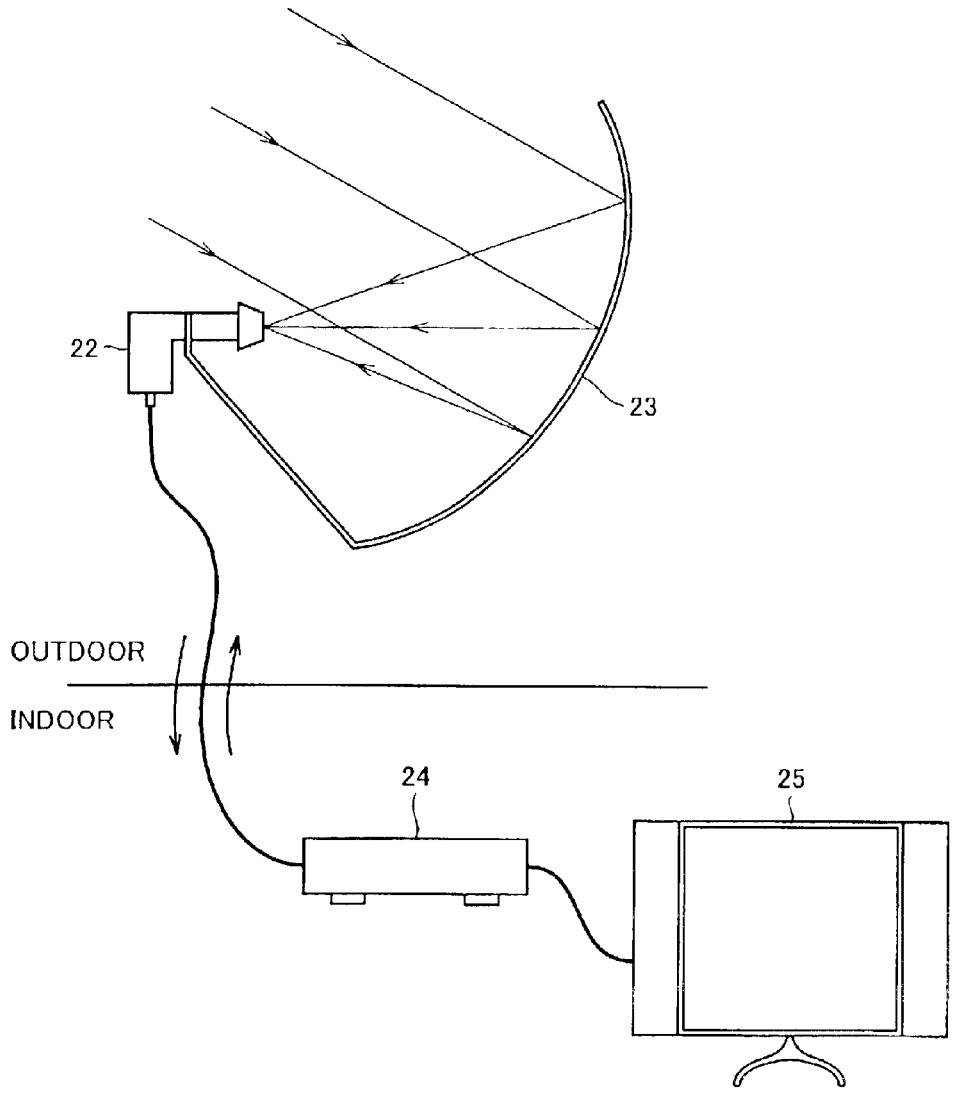
FIG. 14 is a schematic diagram showing an antenna device with the radio wave receiving converter of the present invention.
Figure 15:
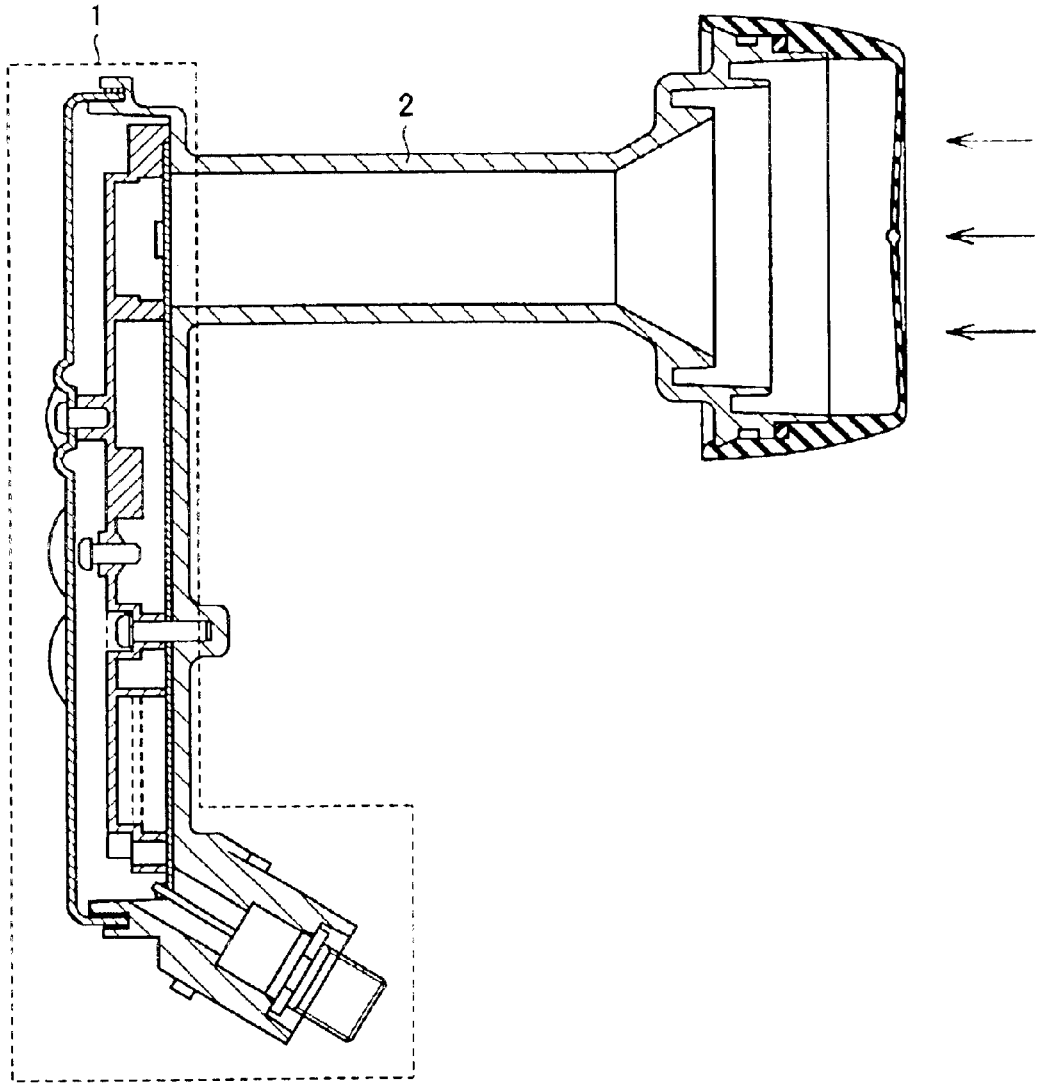
FIG.15 PRIOR ART
FIG. 15 is a cross-sectional view of a conventional radio wave receiving converter.
Figure 16A:
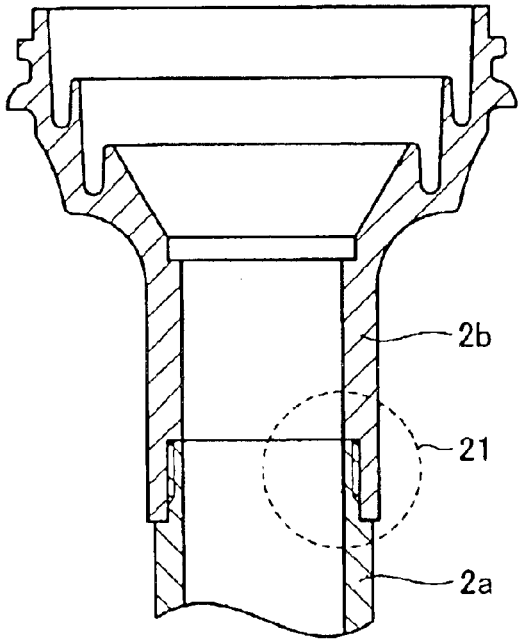
FIG.16A PRIOR ART
FIG. 16A is a cross-sectional view of the feed horn connected portion of the conventional radio wave receiving converter shown in FIG. 15.
Figure 16B:
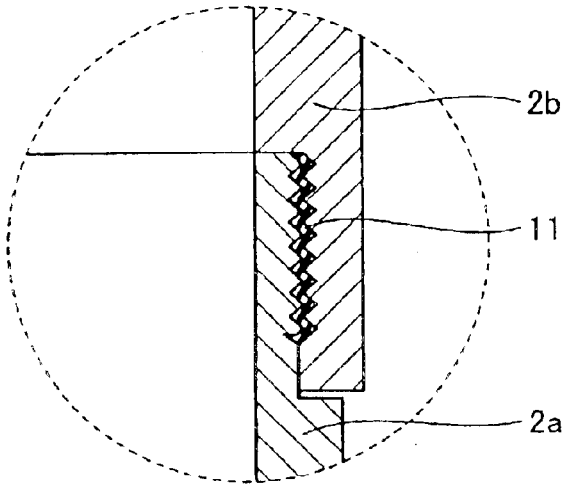
FIG.16B PRIOR ART
FIG. 16B is an enlarged cross-sectional view of a region 21 shown in FIG. 16A.

A ninth embodiment of the present invention will now be described with reference to FIG. 14. FIG. 14 is a schematic diagram showing an antenna device with the LNB in accordance with the present invention.

In the ninth embodiment, a description will be given about the antenna device with the LNB to which the present invention is applied.

As shown in FIG. 14, a radio wave (a signal) from satellite is reflected, converged, lead to, and taken.into an LNB 22 by a reflective parabolic portion 23. These reflective parabolic portion 23 and LNB 22 together form the antenna device.

The radio wave from satellite is a circularly polarized wave, and includes a right-handed polarized wave and a left-handed polarized wave. In radio wave LNB 22, these two components are separated, each component is amplified and converted from a 10-odd GHz band radio wave to a 1 GHz band signal. The converted signal is sent through a cable and an indoor receiving equipment, for example, a satellite receiver 24 to a television 25.

The embodiments of the present invention have been described as above. Features of each embodiment, however, may be combined as appropriate.

As described above, in one aspect of the present invention, the sheet is simply sandwiched between the first and second feed horn portions. Therefore, it is possible to improve the workability in providing the sealing portion. Furthermore, through the employment of the sheet with the adhesive, the more reliable feed horn connected portion in terms of its air tightness can be obtained.

In another aspect of the present invention, the sealing portion is provided at the region away from the screw portions connecting the feed horn portions. Accordingly, the low-viscosity liquid sealing agent, the O ring, the packing, or the like can be utilized. In this case as well, the workability in providing the sealing portion can be improved, while the more reliable feed horn connected portion in terms of its air tightness can be obtained.

In still another aspect of the present invention, the standing wall portion is provided in the first feed horn portion to form the groove portion receiving a part of the second feed horn portion, and the sealing portion is provided inside thereof As a result, a low-viscosity sealing agent or the like can be utilized. In addition, the workability in providing the sealing portion can be improved, while the highly reliable feed horn connected portion in terms of its air tightness can be obtained. Moreover, since a part of the second feed horn portion may simply abut on the sealing portion, or a part of the second feed horn portion may be simply inserted into the sealing portion, easy assembly of the radio wave receiving converter can be obtained.

Accordingly, the workability regarding a connection of the feed horn portions can be improved, while an improvement in reliability of the radio wave receiving converter can be obtained.

Since the antenna device in accordance with the present invention includes the radio wave receiving converter as described above, the reliability thereof is high.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A radio wave receiving converter for receiving satellite broadcast, comprising:

a body portion defining a first feed horn portion and a first threaded portion;

a second feed horn portion defining a second threaded portion complementary to said first threaded portion and screwthreadedly connected to said first feed horn portion; and a sheet sandwiched between said first feed horn portion and said second teed horn portion, and maintaining air tightness at a connected portion of said first feed horn portion and said second feed horn portion.

2. The radio wave receiving converter according to claim 1, wherein an elastic body is inserted between said sheet and said first or second feed horn portion.

3. An antenna device, comprising:

the radio wave receiving converter according to claim 1; and a reflective parabolic portion reflecting a received radio wave and leading said received radio wave to said radio wave receiving converter.

4. A radio wave receiving converter according to claim 1 wherein:

said first feed horn portion has a first centerline and said first threaded portion surrounds said first centerline; and said second feed horn portion has a second centerline and said second threaded portion surrounds said second centerline, is complementary to said first threaded portion, and is screwed into said first threaded portion.

5. A radio wave receiving converter according to claim 1 wherein said first threaded portion projects into said second feed horn portion and comprises an exterior surface of said first feed horn portion.

6. A radio wave receiving converter for receiving satellite broadcast, comprising:

a body portion including a first feed horn portion having a first screw portion;

a second feed horn portion connected to said first feed horn portion and having a second screw portion screwed into said first screw portion; and a sealing portion provided at a region away from said first and second screw portions and maintaining air tightness at a connected portion of said first feed horn portion and said second feed horn portion.

7. The radio wave receiving converter according to claim 6, wherein said second feed horn portion has an extension extending over an outer circumference of said first feed horn portion, said body portion has a groove portion receiving an end of said extension, and said sealing portion is provided in said groove portion.

8. The radio wave receiving converter according to claim 7, wherein said sealing portion includes at least one of a liquid sealing agent and a packing.

9. The radio wave receiving converter according to claim 6, wherein said sealing portion is provided between an end of said second feed horn portion and a receiving portion of said first feed horn portion receiving said end.

10. The radio wave receiving converter according to claim 9, wherein said receiving portion is provided with a groove portion, and said sealing portion is provided in said groove portion.

11. The radio wave receiving converter according to claim 10, wherein said sealing portion includes at least one selected from the group consisting of an O-ring, a packing, and a sealing agent.

12. The radio wave receiving converter according to claim 9, wherein said sealing portion includes an elastic body provided on at least one of the end of said second feed horn portion and the receiving portion of said first feed horn portion.

13. An antenna device, comprising:

the radio wave receiving converter according to claim 6; and a reflective parabolic portion reflecting a received radio wave and leading said received radio wave to said radio wave receiving converter.

14. A radio wave receiving converter for receiving satellite broadcast, comprising:

a body portion including a first feed horn portion;

a second feed horn portion connected to said first feed horn portion;

a standing wall portion provided in said first feed horn portion and forming, in said first feed horn portion, a groove portion receiving a part of said second feed horn portion; and a sealing portion provided in said groove portion and maintaining air tightness at a connected portion of said first feed horn portion and said second feed horn portion.

15. The radio wave receiving converter according to claim 14, wherein said sealing portion includes a sealing agent filled into said groove portion.

16. An antenna device, comprising:

the radio wave receiving converter according to claim 14; and a reflective parabolic portion reflecting a received radio wave and leading said received radio wave to said radio wave receiving converter.

17. A radio wave receiving converter for receiving satellite broadcast, comprising:

a body portion having a first feed horn having a first centerline and a first feed horn threaded portion surrounding said first centerline;

a second feed horn having a second centerline and a second feed horn threaded portion surrounding said second centerline, complementary to said first feed horn threaded portion, and screwed into said first feed horn threaded portion; and a sheet sandwiched between said first feed horn and said second feed horn and maintaining air tightness at a connected portion of said first feed horn and said second feed horn.

18. The radio wave receiving converter according to claim 17 wherein said first centerline is parallel to said second centerline.

19. The radio wave receiving converter according to claim 17 wherein said first centerline and said second centerline are collinear.

20. A radio wave receiving converter for receiving satellite broadcast, comprising:

a body including a first feed horn having a groove;

a second feed horn defining a projection projecting into said groove when said second feed horn is connected to said first feed horn; and sealing means in said groove for forming an air tight seal between said first feed horn and said second feed horn.

21. The radio wave receiving converter of claim 20 wherein said first feed horn includes a first feed horn threaded portion and said second feed horn includes a second feed horn threaded portion complementary to said first feed horn threaded portion.

22. The radio wave receiving converter of claim 21 wherein said first feed horn has a first centerline and said first threaded feed horn portion surrounds said first centerline.

* * * * *